US006516486B1

(12) United States Patent
Mehendale et al.

(10) Patent No.: US 6,516,486 B1
(45) Date of Patent: Feb. 11, 2003

(54) MULTI-TANK EVAPORATOR FOR IMPROVED PERFORMANCE AND REDUCED AIRSIDE TEMPERATURE SPREADS

(75) Inventors: Sunil S. Mehendale, Amherst, NY (US); Steven R. Falta, Ransomville, NY (US); Frederick Vincent Oddi, Orchard Park, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/056,765

(22) Filed: Jan. 25, 2002

(51) Int. Cl.[7] ..... F25B 39/02; F25B 43/00

(52) U.S. Cl. ..... 9/503; 62/525; 165/153; 165/173; 165/174

(58) Field of Search ..... 62/525, 503, 504, 62/519, 524, 526; 165/152, 153, 172, 173, 174, 175, 176

(56) References Cited

U.S. PATENT DOCUMENTS

| | | | | |
|---|---|---|---|---|
| 2,124,291 A | | 7/1938 | Fleisher | 257/1 |
| 4,712,612 A | | 12/1987 | Okamoto et al. | 165/62 |
| 4,821,531 A | | 4/1989 | Yamauchi et al. | 62/515 |
| 4,969,512 A | | 11/1990 | Hisao et al. | 165/153 |
| 5,024,269 A | | 6/1991 | Noguchi et al. | 165/153 |
| 5,042,577 A | * | 8/1991 | Suzumura | 165/153 |
| 5,172,759 A | | 12/1992 | Shimoya et al. | 165/110 |
| 5,205,347 A | * | 4/1993 | Hughes | 165/1 |
| 5,701,760 A | | 12/1997 | Torigoe et al. | 62/524 |
| 6,272,881 B1 | * | 8/2001 | Kuroyanagi et al. | 62/525 |
| 6,397,938 B1 | * | 6/2002 | Nishishita | 165/153 |
| 6,401,804 B1 | * | 6/2002 | Shimoya et al. | 165/70 |
| 6,431,264 B2 | * | 8/2002 | Tooyama et al. | 165/153 |
| 6,449,979 B1 | * | 9/2002 | Nagasawa et al. | 62/503 |
| 2002/0079093 A1 | * | 6/2002 | Rong | 165/153 |

FOREIGN PATENT DOCUMENTS

| | | |
|---|---|---|
| JP | 61-55596 A | 3/1986 |
| JP | 3-137493 A | 6/1991 |

* cited by examiner

*Primary Examiner*—Denise L. Esquivel
*Assistant Examiner*—Marc Norman
(74) *Attorney, Agent, or Firm*—Patrick M. Griffin

(57) ABSTRACT

An evaporator for an HVAC system is disclosed wherein an upstream to downstream airflow is directed through the evaporator for inducing a transfer of thermal energy between the airflow and a fluid circulating in the evaporator. The evaporator includes at least two cores adjacent one to the other. Each of the cores defines a core inlet and a core outlet and the cores are arranged such that the core inlet of the first core is positioned at an opposite end from the inlet of the second core. Correspondingly, the outlet of the first core is positioned at an opposite end from the outlet of the second core. The evaporator inlet is in fluid communication with the first core inlet and the second core inlet and the outlet is in fluid communication with the first core outlet and the second core outlet.

29 Claims, 5 Drawing Sheets

MULTI-TANK EVAPORATOR FOR IMPROVED PERFORMANCE AND REDUCED AIRSIDE TEMPERATURE SPREADS

TECHNICAL FIELD

The present invention relates to an evaporator for a heating, ventilating and air-conditioning system in general, and more specifically to an evaporator having multiple fluid paths.

BACKGROUND OF THE INVENTION

Evaporators in general are well known in various configurations for routing a refrigerant through a plurality of tubes to absorb heat or thermal energy from air passing around the tubes. The cooled air is then directed to an enclosure such as a vehicle for the comfort of individuals therein. In general, a refrigerant medium is routed to an input tank whereupon the refrigerant is further routed through a plurality of tubes to an outlet tank for return back to a compressor. The tubes through which the refrigerant flows are arranged so that the airflow to be cooled passes in proximity to the tubes and contacts a large surface area of the tubes. These arrangements typically also include multiple air fins arranged axially with the airflow and extending between adjacent tubes thereby increasing the contact surface area to aid in the transfer of heat from the air to the circulating refrigerant. The refrigerant is continuously circulated in a closed loop fashion for continuous cooling of air flowing through the evaporator.

To obtain the maximum heat transfer from the air to the refrigerant, the refrigerant is routed to make multiple passes through the air stream to be cooled prior to being discharged from the evaporator for recirculation. As the refrigerant makes each individual pass through the air stream and absorbs more thermal energy, its cooling capacity decreases. Therefore, the portion of the airflow through the tubes carrying the initial pass of the refrigerant is cooled to a greater extent than the air passing farther downstream of the refrigerant flow. This results in an undesirable non-uniform discharge air temperature.

The problem of non-uniform discharge air temperatures in HVAC modules may be traced, at least partially, to imperfect evaporator core designs. Current evaporator designs exhibit two significant problems. First, a single core operating under given test conditions provides good cooling capacity but causes a non-uniform outlet air temperature distribution (i.e., a large temperature spread) under certain conditions as a result of non-uniform refrigerant flow in some passes or operation at high superheats. For this reason evaporators incorporating two cores with refrigerant flowing through the cores in series have been constructed within the same core depth as a single core. Although this design provides a more desirable temperature spread, the desirable temperature spread is obtained at the expense of cooling capacity. The degradation in the associated cooling performance is a result of the severe refrigerant pressure drop in the system.

The general construction of a dual core evaporator is well known in the art and generally comprises an upstream core through which the air to be cooled passes first and a downstream core immediately downstream and adjacent to the upstream core. The air exiting the upstream core immediately enters the downstream core for additional cooling. Each core has an upper tank and a lower tank with a plurality of tubes extending between the two tanks wherein the adjacent tubes have multiple cooling fins extending from one to the other. The refrigerant makes multiple passes through successive groups of tubes in the upstream core and is then routed to the downstream core where the refrigerant makes multiple passes through like but opposite successive tube groups and then exits the evaporator.

Other configurations of evaporators employ a "U" flow wherein the refrigerant enters an upstream core and is first routed through one group of tubes and then to the corresponding group of tubes in the downstream core. The refrigerant flows span wise down the evaporator to the next group of tubes whereupon the refrigerant flows through the downstream group and is then transferred to the corresponding upstream group of tubes and so on. The refrigerant flow finally ends at an end of the evaporator opposite from the inlet. Since it is desirable to have the evaporator inlet and outlet at the same side of the evaporator the "U" flow designs also incorporate an additional tank to route the refrigerant back to the end of the evaporator at which the refrigerant entered. However, none of the current designs, either single core or multi-core, provide optimization of both a uniform outlet air temperature distribution and cooling capacity.

Thus, there is a need for an HVAC evaporator that exhibits both a high efficiency and a uniform outlet air temperature distribution.

SUMMARY OF THE INVENTION

In one aspect, the present invention includes an evaporator for an HVAC system wherein an upstream to downstream airflow is directed through the evaporator for inducing a transfer of thermal energy between the airflow and a fluid circulating in the evaporator. The evaporator includes at least two cores adjacent one to the other. Each of the cores defines a core inlet and a core outlet and the cores are arranged such that the core inlet of the first core is positioned at an opposite end from the inlet of the second core. Correspondingly, the outlet of the first core is positioned at an opposite end from the outlet of the second core. The evaporator inlet is in fluid communication with the first core inlet and the second core inlet and the outlet is in fluid communication with the first core outlet and the second core outlet.

Another aspect of the present invention includes an evaporator for an HVAC system of the type wherein an upstream to downstream airflow is directed through the evaporator for inducing a transfer of thermal energy between the airflow and a fluid circulating in the evaporator. The evaporator includes a plurality of tube plates each plate having a face and a back. The plurality of tube plates are arranged in alternating fashion, face-to-face, back-to-back, and define at a top portion thereof a top upstream tank and a top downstream tank. The two plates further define at a bottom portion thereof a bottom upstream tank and a bottom downstream tank. Each of the tanks substantially extend from a first end of the evaporator to a second end of the evaporator. Each of the back-to-back arranged pairs of tube plates also define an upstream tube extending from the top upstream tank to the bottom upstream tank wherein the tube is in fluid communication with the tanks for permitting a fluid flow between the top upstream tank and the bottom upstream tank. The back-to-back arranged pairs of tube plates further define a downstream tube extending from the top downstream tank to the bottom downstream tank and in fluid communication therewith for permitting a fluid flow between the top downstream tank and the bottom downstream tank. A first endplate at the first end of the evaporator defines an input in fluid communication with one of the upstream tanks at the first end of the evaporator and with one of the downstream tanks at a second end of the evaporator. The first endplate further defines an output in fluid communication with a second of the upstream tanks at the second end of the evaporator and with a second of the downstream tanks at the first end of the evaporator. A second endplate is positioned at the second end of the evaporator.

Yet another aspect of the present invention is a method of transferring a thermal transfer fluid flow through an evaporator of an HVAC system of the type having an upstream core including a plurality of thermal transfer tubes and a downstream core including a plurality of thermal transfer tubes and an inlet and an outlet wherein the method comprises the steps of inputting the thermal transfer fluid flow into the inlet and then splitting the thermal transfer fluid flow to an upstream flow and a downstream flow. The upstream flow is then directed through the upstream core from a first end of the evaporator to a second end of the evaporator, and the downstream flow is directed through the downstream core from the second end of the evaporator to the first end of the evaporator. The upstream flow and downstream flow are combined at the outlet and the fluid flow is then output from the outlet.

DESCRIPTION OF THE PREFERRED EMBODIMENT

Figure 2:
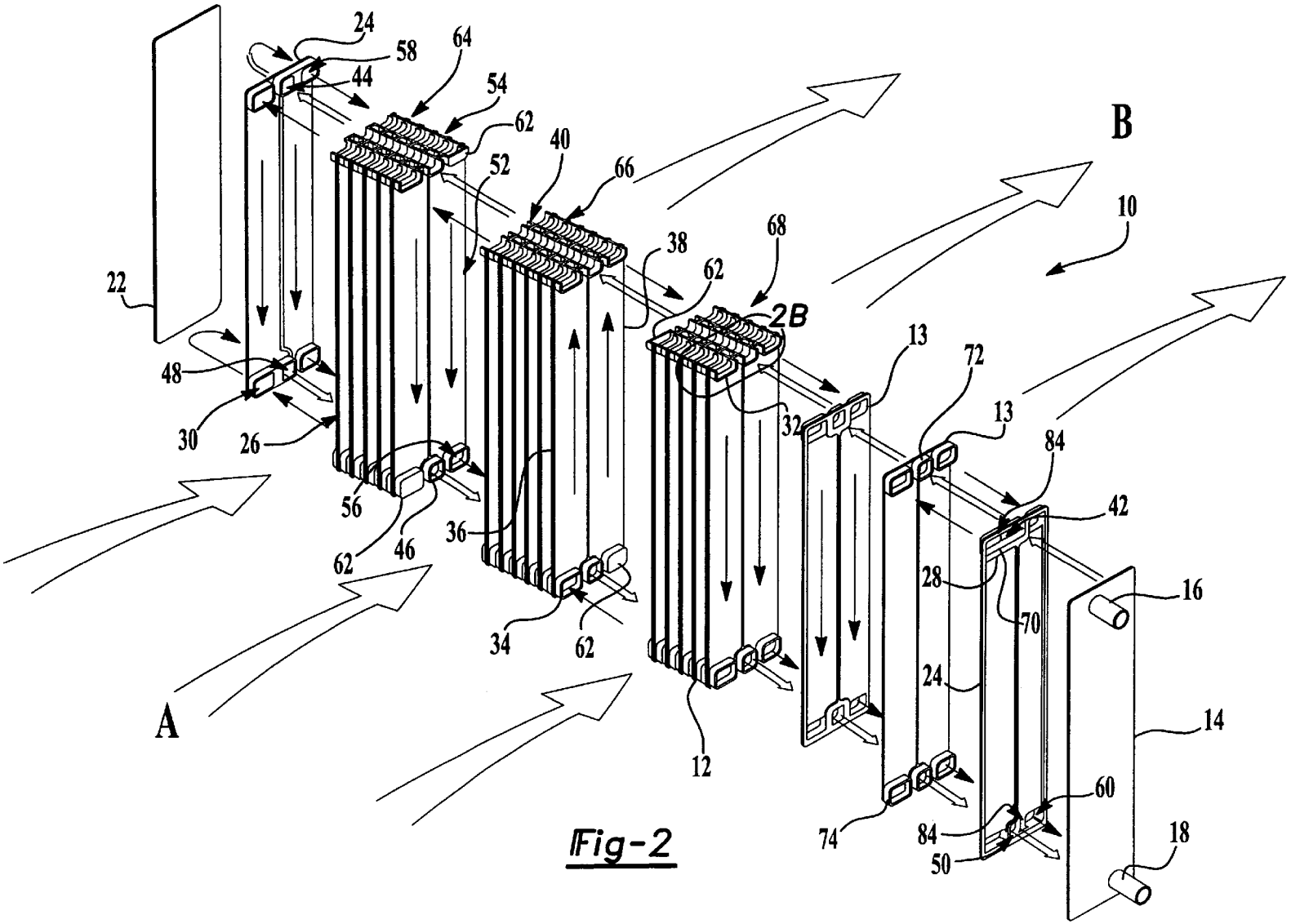
FIG. 2 is an exploded perspective view of the evaporator of FIG. 1 showing the top tanks in partial section.

For purposes of description herein, the terms "upper", "lower", "left", "rear", "right", "front", "vertical", "horizontal", and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
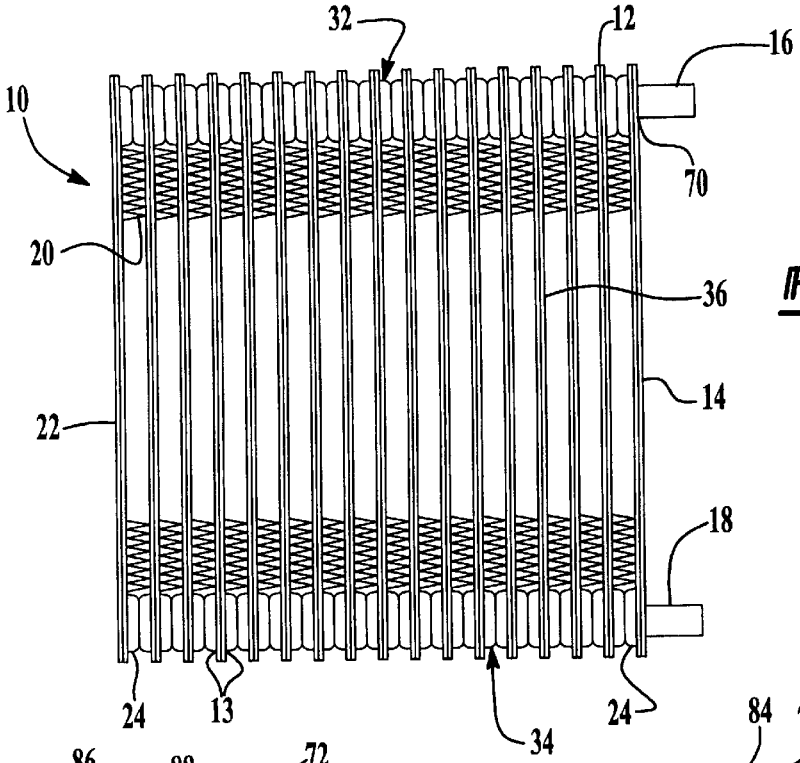
FIG. 1 is an elevational view from the upstream side of an evaporator embodying the present invention.
Figure 3:
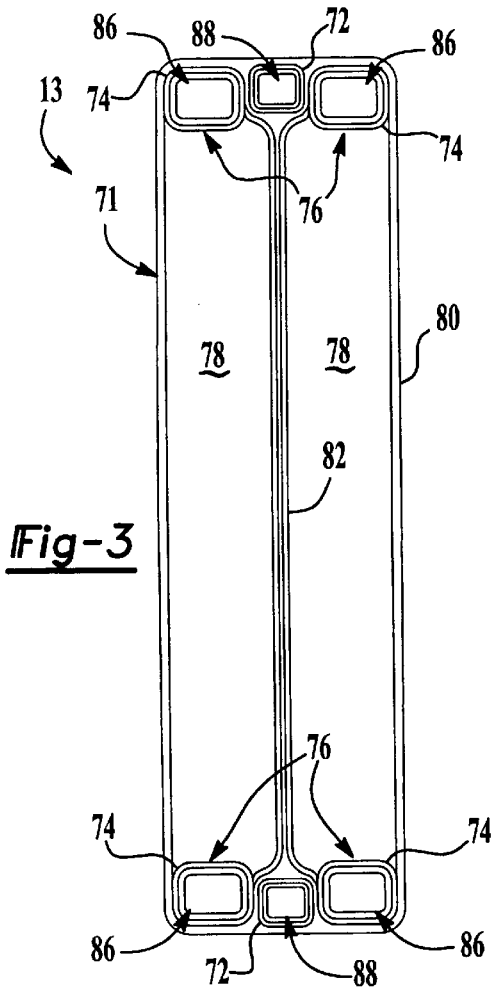
FIG. 3 is an elevational view of a tube plate for the central portion of the evaporator cores.
Figure 4:
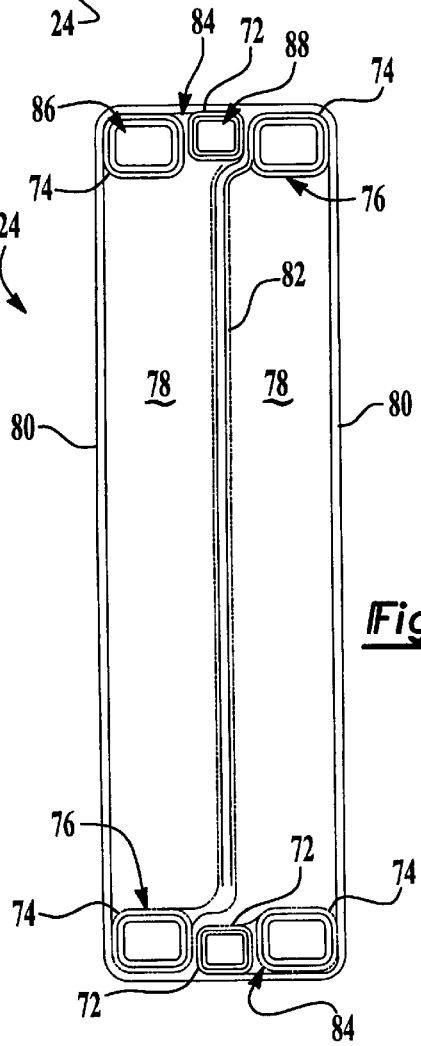
FIG. 4 is an elevational view of a connector tube plate for each end of the evaporator core.

The reference numeral 10 (FIG. 1) generally designates an evaporator embodying the present invention. In the illustrated example, evaporator 10 comprises a plurality of tube assemblies 12 arranged in a stacked or back-to-back manner and brazed together to form the central portion of evaporator 10. Each tube assembly 12 is comprised of identical tube plates 13 arranged in a face-to-face manner and also brazed together. Referring to FIG. 3, a tube plate 13 of the present embodiment modifies a design relatively well known in the evaporator art wherein tube plate 13 generally comprises a peripheral outer flange 80 and a central inner flange 82, the flanges defining cavities 78 therebetween. At each of the four corners of plate 13 is a core cup 74 extending from a backside of plate 13. Cups 74 are flush with flanges 80 and 82 such that when respective faces 71 of plates 13 are mated one to the other and brazed together, successive cups 74 create core tank segments 86.

Core tank segment 86 defines an aperture 76 therethrough to permit fluid flow from tank segment 86 at one end of tube assembly 12 through cavity 78 to the adjoining tank segment 86. Additionally, a transfer cup 72 is included between cups 74 and also extends from a back of plate 13 in a manner identical to cups 74 such that when plates 13 are brazed face-to-face, cups 72 form a transfer tank segment 88. Thus, when successive tube assemblies 12 are assembled in their back-to-back manner, they form a top tank 32 and a bottom tank 34 with a plurality of tubes 36 extending between tanks 32 and 34. Tubes 36 are in fluid communication with the tanks to permit the flow of a fluid between tanks 32 and 34.

A connector tube plate 24 is substantially identical to tube plate 13 in that plate 24 has an outer flange 80 and a central inner flange 82, cavities 78 and cups 74 at each of the four corners of plate 24. Additionally, transfer tank cups 72 are positioned between each upper and lower pair of cups 74. However, a connector cavity 84 is defined between the top left cup 74 and the top transfer tank cup 72. Cavity 84 causes top left cup 74 and transfer tank cup 72 to be in fluid communication one with the other. Likewise, a like cavity 84 is defined at the bottom right cup 74 and the bottom transfer tank 72 to place bottom right cup 74 and bottom transfer cup 72 in fluid communication one with the other.

A solid endplate 22 is brazed to the face of coupling tank 24 on the left side of evaporator 10 and endplate 14 is likewise brazed to the face of connector plate 24 at the right end of the evaporator. Endplate 14 also includes an input 16 and at a top of plate 14 and an output 18 at the bottom of plate 14. Input 16 is in fluid communication with the top cavity 84 of connector plate 24 and outlet 18 is in fluid communication with the bottom cavity 84 of connector plate 24. A plurality of air fins 20 extend between adjacent tubes 36 and are longitudinally oriented along the desired airflow path.

Referring now to FIG. 2, evaporator 10 is shown in an exploded perspective view. An upstream airflow designated by arrows "A" enters an upstream side of evaporator 10 whereupon the air is cooled and exits as a downstream airflow "B". Evaporator 10 in the preferred embodiment is shown as having seventeen tube assemblies 12 with connector plates 24 each defining one-half of a tube assembly at each end of evaporator 10.

Evaporator 10 in its preferred embodiment comprises an upstream core 26 which includes a top upstream tank 32 and a bottom upstream tank 34 interconnected by a plurality of upstream tubes 36. Likewise, evaporator 10 also includes a second downstream core 52 including a top downstream tank 54 and a bottom downstream tank 56 interconnected by a plurality of downstream tubes 38. Each tube assembly 12 forms a portion of first upstream core 26 and a portion of second downstream core 52.

Evaporator 10 in the illustrated embodiment is configured such that the fluid flowing through each of upstream core 26 and downstream core 52 makes three passes through the respective core. This is accomplished by dividing the tube assemblies 12 into three substantially equal groups. However, since endplates at both the left and right ends of evaporator 10 only form the equivalent of one-half of a tube assembly an equal 6-6-6 grouping is not possible. Thus, left tube group 64 comprises five tube assemblies 12 plus the one-half tube assembly created by connector plate 24. Center tube group 66 comprises six tube assemblies 12, and right tube group 68 comprises six tube assemblies 12 plus the one-half tube assembly of connector plate 24.

In order to induce the fluid to make three successive passes through each of the core segments of a tube group, a blind 62 is placed in each of the core tubes at the interface of two of the tube groups.

In the disclosed embodiment of evaporator 10, the successive transfer tube cups 72 form a top transfer tank 40 which is the inlet transfer tank for the downstream core 52. Likewise, bottom transfer cups 72 form bottom transfer tank 46 which is the outlet tank for upstream core 26. The fluidic communication created by cavities 84 and plates 24 provide for the proper routing of the fluid through the respective cores. Specifically, at the right connector tank 24 cavity 84 provides for the fluidic communication between evaporator inlet 16, upstream core inlet 28 and top transfer tank inlet 42. The bottom cavity 84 of right-hand connector plate 24 fluidically interconnects downstream core outlet 60 and bottom transfer tank outlet 50 with evaporator outlet 18. At the left side of evaporator 10 the top cavity 84 fluidically interconnects top transfer tank outlet 44 with downstream core inlet 58, and at the bottom of left-hand plate 24 the corresponding cavity 84 fluidically interconnects the upstream core outlet 30 with the bottom transfer tank inlet 48. By routing the refrigerant fluid flow in this manner, an opposite parallel flow is induced through the respective upstream and downstream cores.

Figure 5:
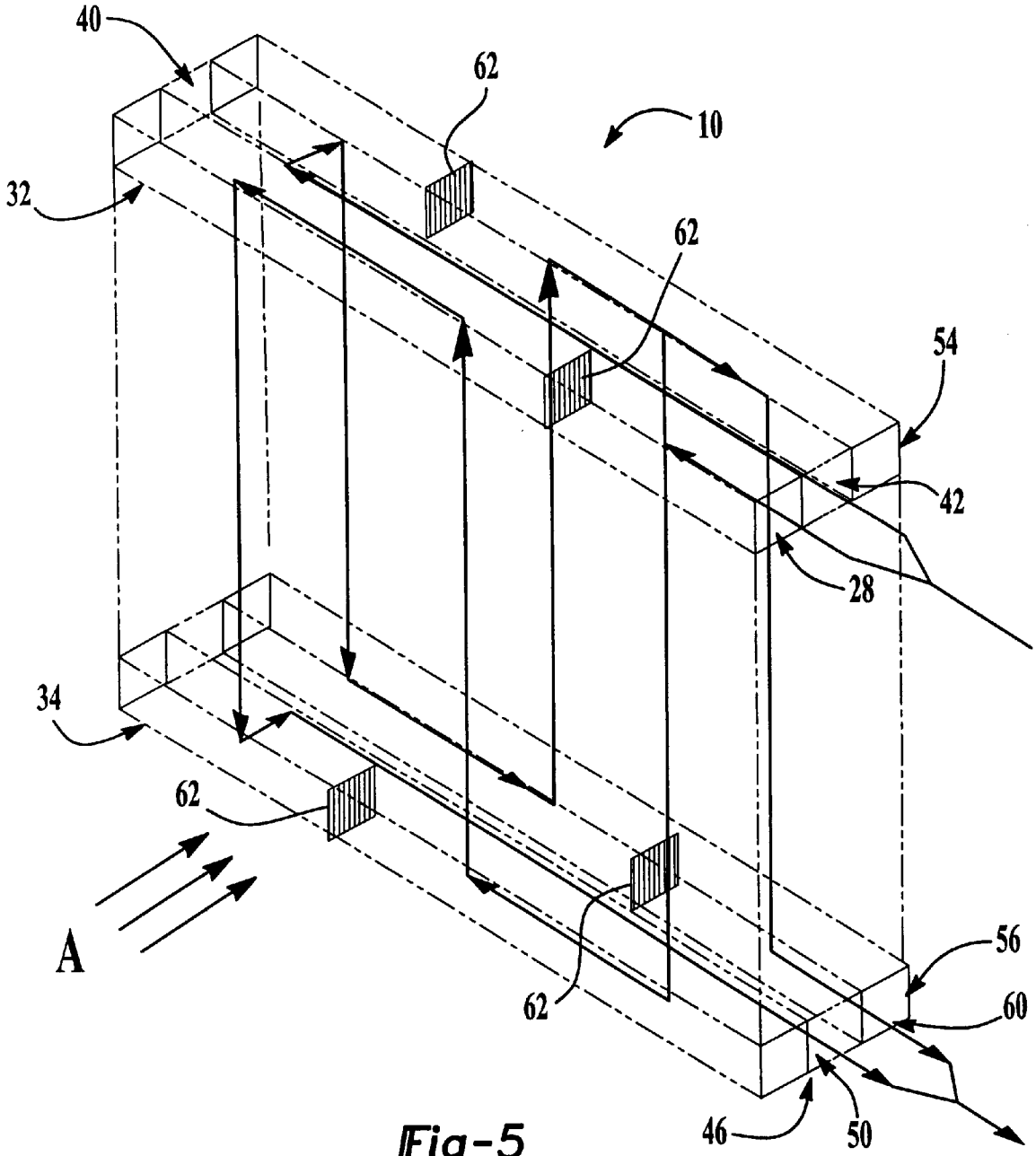
FIG. 5 is a schematic diagram of the evaporator of FIG. 2 illustrating the opposite, parallel flow of the refrigerant through the evaporator.

Referring to FIG. 5, evaporator 10 is shown in phantom schematic representation more clearly illustrating the flow input from inlet 16 being divided into a flow corresponding to upstream core inlet 28 and top transfer tank 42. FIG. 5 illustrates the multiple pass flow through each of the upstream and downstream cores induced by the placement of blinds 62 between respective tube groups in a manner well known in the evaporator art.

The input and division of the refrigerant flow for proper division between the two cores in the correct proportion for optimum cooling performance and discharge spreads is also required. The refrigerant flow for each core can be individually controlled such as by controlling the outlet superheats or the refrigerant pressure drops for the two cores. This can be achieved in practice by using two separate control devices for the two cores or by designing a single control device for the two cores. In those embodiments wherein the optimum cooling capacity and the temperature spread are not very sensitive to the mass flow rate ratio through the two cores, a static or fixed division control can be employed such as building a fixed restriction into the downstream core through use of variable size blinds, or pipes of variable diameters and lengths.

Figure 6:
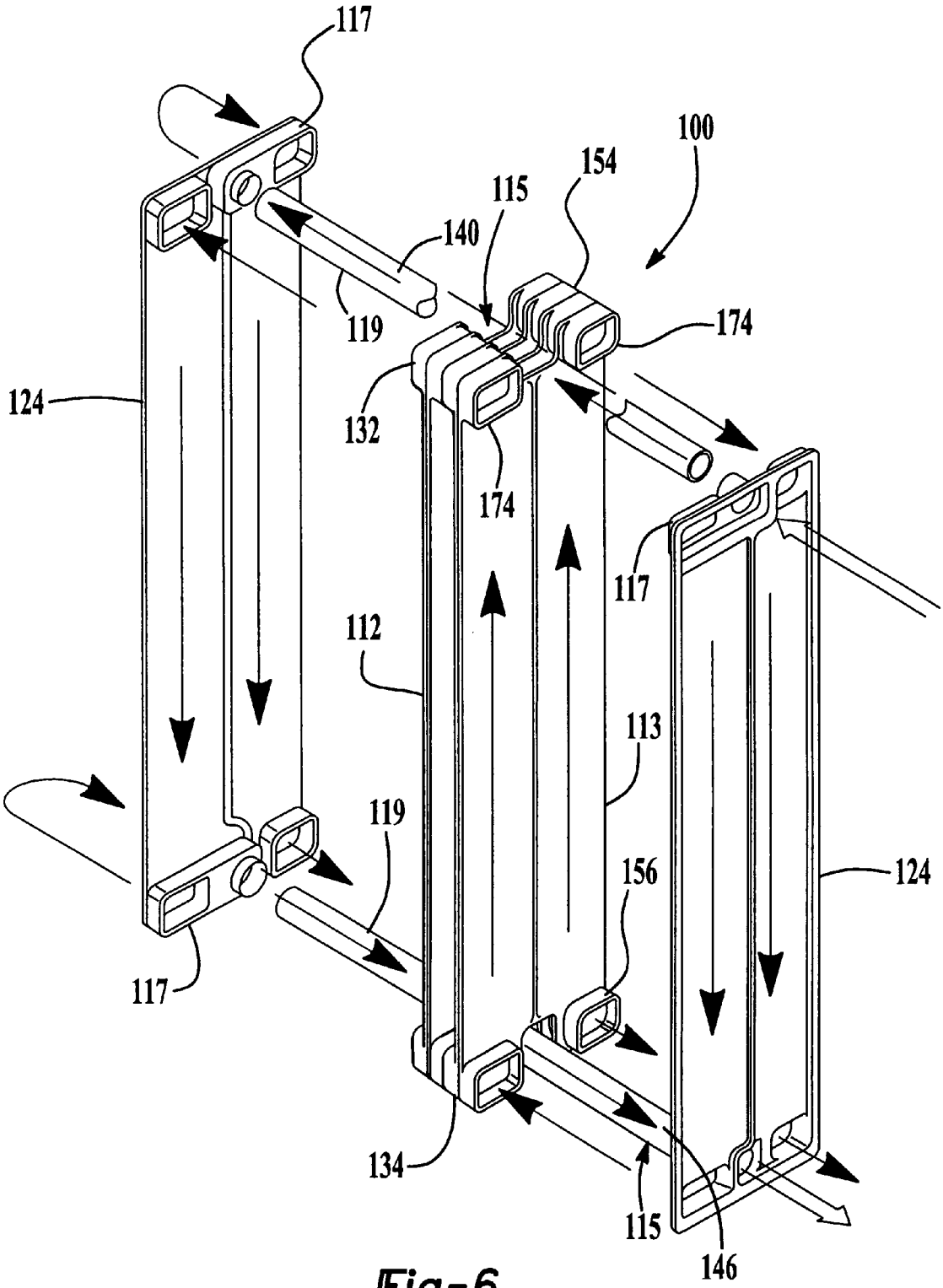
FIG. 6 is a perspective segmented view of an alternate embodiment of the evaporator illustrating the use of a tube replacing each transfer tank.

FIG. 6 illustrates an alternate embodiment evaporator 100 and it's various elements. Like or similar elements as illustrated with respect to evaporator 10 are identified with a like reference number precede by the number "1". Evaporator 100 includes a plurality of tube assemblies 112, and when assembled define top and bottom upstream tanks 132 and 134 and top and bottom downstream tank 154 and 156 that function in a manner the same as described above for evaporator 10. Each tube assembly 112 is formed from two tube plates 113. Tube plates 113 are similar to tube plates 13, however, tube plates 113 do not include a transfer cup between core cups 74 thus defining a void therebetween. When tube assemblies 112 are assembled to form evaporator 100, adjacent top tubes 132 and 154 and bottom tubes 134 and 156 respectively define therebetween channels 115. Each of endplates 124 include connector tanks 117 at the top and bottom thereof. Connector tank 117 can be integrally formed with endplate 124, or can be a tank that is formed separately from endplate 124 and added when evaporator 100 is assembled. Connector tank 117, depending on its upstream, downstream, top or bottom location fluidically communicates with one of tanks 132, 134, 154, or 156. Each connector tank 117 also fluidically communicates with a pipe 119 received in channel 115. Once assembled, the top pipe 119 functions as transfer tank 140 and the bottom pipe 119 functions as transfer tank 146 in a manner similar to transfer tanks 40 and 46 in evaporator 10. One end of evaporator 100 also includes an inlet and an outlet to the evaporator, each of the inlet and outlet preferable being on one end of evaporator 100 and each fluidically communicating with one of the connector tanks 117. Evaporator 100 functions in the same manner as evaporator 10 to split the coolant input to the evaporator into both an upstream and a downstream flow. The utilization of pipes 119 instead of the integrally formed transfer tanks of evaporator 10 eliminates the necessity of forming three cup formations adjacent one another at each end of the tube plate.

Figure 7:
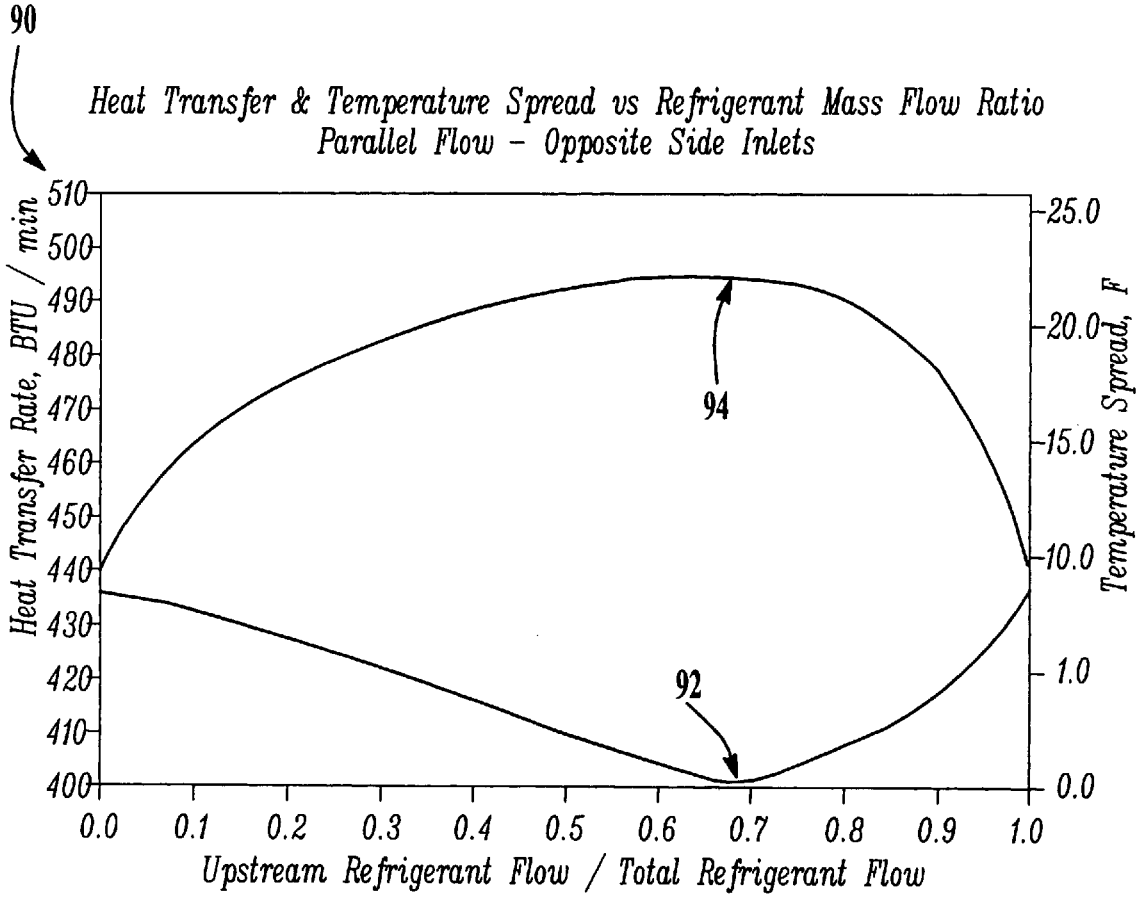
FIG. 7 is a graph of the heat transfer and temperature spread versus the refrigerant mass flow ratio for a parallel refrigerant flow in an evaporator embodying the present invention.

To obtain a most efficient operation of an evaporator employing an opposite parallel flow through respective cores, the total refrigerant input flow at evaporator inlet 16 is preferably divided to provide a desired percentage of fluid for the upstream core flow and the remainder designated for the downstream core flow. Graph 90 in FIG. 7 illustrates the heat transfer capability of evaporator 10 and the respective temperature spreads between the upstream and downstream cores for different percentages of flow through the respective upstream and downstream cores. Maximum heat transfer is shown at 94 and generally corresponds with the minimum temperature spread of the downstream air. The point of minimum temperature spread is shown at 92. Generally, maximum efficiency 94 and minimum temperature spread 92 occur when the upstream core receives greater than 50% of the refrigerant flow and the downstream core receives the remainder of the refrigerant flow. More ideally, the highest efficiency operation of evaporator 10 occurs when 60% to 80% of the refrigerant fluid is directed to the upstream core. In order to effect such a division of fluid flow in a measured manner, a fluid divider 70 is employed. In the preferred embodiment as shown in evaporator 10, flow divider 70 comprises forming upstream core inlet 28 and top transfer tank inlet 42 with different cross-sectional areas wherein the specific areas for each inlet are selected to induce the correct flow percentage to each of the respective upstream and downstream cores. Flow division is also affected by the placement of inlet 16 with respect to inlets 28 and 42.

Those skilled in the art will understand that alternative constructions embodying the concept of arranging the cores in a manner to cause an opposite and parallel flow of fluid through two cores of an evaporator are possible. Although evaporator 10 as disclosed herein illustrates the refrigerant fluid making three passes through each of the individual cores, a different number of odd passes can be accomplished by increasing the number of tube groups and appropriately spaced blinds 62. The concept described herein can also be applied to an even number of passes wherein the cavity 84 defined by connector plates 24 is altered to make the appropriate fluid passage between the core tanks and transfer tanks at the end opposite from the evaporator inlet 16 and outlet 18. In applications where space is not a major constraint, external piping of different configurations can be utilized to effect the oppositely located core inlets and core outlets in lieu of integrally forming or locating them within the profile of the tube plates.

In the foregoing description, those skilled in the art will readily appreciate that modifications may be made to the invention without departing from the concepts disclosed herein. Such modifications are to be considered as included in the following claims, unless these claims by their language expressly state otherwise.

What is claimed is:

1. An evaporator for HVAC systems of the type wherein an upstream to downstream airflow is directed through said evaporator for inducing a transfer of thermal energy between the airflow and a fluid circulating in said evaporator, said evaporator comprising:

at least two cores adjacent one to the other, each of said cores defining a core inlet and a core outlet wherein said cores are arranged such that a first core inlet of a first of said cores is positioned at an opposite end from a second core inlet of a second of said cores, and a first core outlet of said first core is positioned at an opposite end from a second core outlet of said second core;

an evaporator inlet in fluid communication with said first core inlet and with said second core inlet; and an evaporator outlet in fluid communication with said first core outlet and with said second core outlet.

2. An evaporator according to claim 1 further including:

an inlet transfer tank in fluid communication with said evaporator inlet and with said second core inlet; and an outlet transfer tank in fluid communication with said evaporator outlet and with said first core outlet.

3. An evaporator according to claim 1 further including a flow diverter at said evaporator inlet for diverting a portion of the fluid flow at said evaporator inlet to said first core inlet and a portion of the fluid flow to said inlet tank.

4. An evaporator according to claim 3 wherein said diverter separates the fluid flow in a proportion of greater than 50% to said first core and less than 50% to said second core.

5. An evaporator according to claim 4 wherein said first core is an upstream core.

6. An evaporator according to claim 3 wherein said diverter separates the fluid flow in a proportion of 60%–80% to said first core and 40%–20% to said second core.

7. An evaporator according to claim 6 wherein said first core is an upstream core.

8. An evaporator according to claim 1 wherein each of said first and said second cores further comprise a plurality of tubes for transferring the fluid flow therethrough from said core inlet to said core outlet and further wherein said plurality of tubes are divided into a plurality of tube groups, and further wherein said groups are arranged to receive the fluid flow in series.

9. An evaporator according to claim 8 wherein each said core comprises an odd number of tube groups.

10. An evaporator according to claim 9 wherein each said core comprises three tube groups.

11. An evaporator according to claim 1 wherein said evaporator inlet and said evaporator outlet are at a same end of said evaporator.

12. An evaporator according to claim 10 wherein one of said evaporator inlet and said evaporator outlet is positioned at a top of said evaporator end, and the other of said evaporator inlet and said evaporator outlet is positioned at a bottom of said evaporator end.

13. An evaporator for HVAC systems of the type wherein an upstream to downstream airflow is directed through said evaporator for inducing a transfer of thermal energy between the airflow and a fluid circulating in said evaporator, said evaporator comprising:

a plurality of tube plates, each plate having a face and a back, said plurality of tube plates arranged in alternating fashion, face to face, back to back, and defining at a top portion thereof, a top upstream tank and a top downstream tank, and at a bottom portion thereof, a bottom upstream tank and a bottom downstream tank wherein each of said tanks substantially extends from a first end of said evaporator to a second end of said evaporator, and further wherein each of said back to back arranged pairs of tube plates define an upstream tube extending from said top upstream tank to said bottom upstream tank and in fluid communication therewith for permitting a fluid flow between said top upstream tank and said bottom upstream tank and further define a downstream tube extending from said top downstream tank to said bottom downstream tank and in fluid communication therewith for permitting a fluid flow between said top downstream tank and said bottom downstream tank;

a first endplate at said first end of said evaporator, said first endplate defining an input in fluid communication with one of said upstream tanks at said first end and with one of said downstream tanks at a second end of said evaporator, and further defining an output in fluid communication with a second of said upstream tanks at said second end and with a second of said downstream tanks at said first end;

a second endplate at said second end of said evaporator.

14. An evaporator according to claim 13 wherein said plurality of plates further define a top transfer tank and a bottom transfer tank, said transfer tanks substantially extending from said first end to said second end.

15. An evaporator according to claim 14 wherein:

one of said transfer tanks is in fluid communication with said input and said one of said downstream tanks at said second end for transferring fluid from said input to said one of said downstream tanks; and a second of said transfer tanks is in fluid communication with said output and said second of said upstream tanks at said second end for transferring fluid from said second of said upstream tanks to said output.

16. An evaporator according to claim 15 further including a first connector plate, said first connector plate mated to said second endplate and defining in combination therewith:

a first cavity fluidically connecting said one of said transfer tanks with said one of said downstream tanks; and a second cavity fluidically connecting said second of said transfer tanks with said second of said upstream tanks.

17. An evaporator according to claim 16 further including a second connector plate, said connector plate mated to said first endplate and defining in combination therewith:

a third cavity fluidically connecting said input with said one of said transfer tanks and with said one of said downstream tanks; and a fourth cavity fluidically connecting said output with said second of said transfer tanks and said second of said upstream tanks.

18. An evaporator according to claim 17 further including:

a fluid divider proximate to said inlet and in fluid communication with said one of said transfer tanks and with said one of said downstream tanks for directing a portion of the fluid flow to said one of said transfer tanks and a portion of the fluid flow to said one of said downstream tanks.

19. An evaporator according to claim 18 further including:

at least one blind in each of said upstream tanks and each of said downstream tanks and positioned intermediate to said first and said second ends thereof for alternately directing the fluid flow through successive groups of said tubes.

20. An evaporator according to claim 13 wherein said plurality of plates further define a top channel and a bottom channel and further includes:

a first pipe forming a top transfer tank being received in said top channel and extending from said first end to said second end; and a second pipe forming a bottom transfer tank being received in said bottom channel and extending from said first end to said second end.

21. An evaporator according to claim 20 wherein:

one of said transfer tanks is in fluid communication with said input and said one of said downstream tanks at said second end for transferring fluid from said input to said one of said downstream tanks; and a second of said transfer tanks is in fluid communication with said output and said second of said upstream tanks at said second end for transferring fluid from said second of said upstream tanks to said output.

22. An evaporator according to claim 21 further including:

a first connector tank defining a first cavity fluidically connecting said one of said transfer tanks with said one of said downstream tanks; and a second connector tank defining a second cavity fluidically connecting said second of said transfer tanks with said second of said upstream tanks.

23. An evaporator according to claim 22 further including:

a third connector tank defining a third cavity fluidically connecting said input with said one of said transfer tanks and with said one of said downstream tanks; and a fourth connector tank fluidically connecting said output with said second of said transfer tanks and said second of said upstream tanks.

24. An evaporator according to claim 23 further including:

a fluid divider proximate to said inlet and in fluid communication with said one of said transfer tanks and with said one of said downstream tanks for directing a portion of the fluid flow to said one of said transfer tanks and a portion of the fluid flow to said one of said downstream tanks.

25. An evaporator according to claim 24 further including:

at least one blind in each of said upstream tanks and each of said downstream tanks and positioned intermediate to said first and said second ends thereof for alternately directing the fluid flow through successive groups of said tubes.

26. A method of transferring a thermal transfer fluid flow through an evaporator of an HVAC system of the type having an upstream core including a plurality of thermal transfer tubes and a downstream core including a plurality of thermal transfer tubes, an inlet, and an outlet, said method comprising the steps of:

inputting the thermal transfer fluid flow into the inlet;

splitting the thermal transfer fluid flow to an upstream flow and a downstream flow;

directing the upstream flow through the upstream core from a first end of the evaporator to a second end of the evaporator;

directing the downstream flow through the downstream core from the second end of the evaporator to the first end of the evaporator;

combining the upstream flow and the downstream flow at the outlet; and outputting the thermal transfer fluid flow from the outlet.

27. The method according to claim 26 wherein the splitting step comprises:

splitting the transfer fluid flow to direct greater than 50% of the thermal transfer fluid to the upstream flow, and less than 50% of the thermal transfer fluid to the downstream flow.

28. The method according to claim 27 wherein the splitting step comprises:

splitting the transfer fluid flow to direct 60%–80% of the thermal transfer fluid to the upstream flow, and 40%–20% of the thermal transfer fluid to the downstream flow.

29. The method according to claim 28 wherein:

the step of directing the upstream flow through the upstream core includes directing the upstream flow through the plurality of upstream tubes; and the step of directing the downstream flow through the downstream core includes directing the downstream flow through the plurality of downstream tubes.

* * * * *